United States Patent [19]

Beier

[11] 4,297,864

[45] Nov. 3, 1981

[54] KEY HOLDER

[76] Inventor: Hanns W. Beier, 853 Scarsdale Rd., Crestwood, N.Y. 10707

[21] Appl. No.: 154,004

[22] Filed: May 28, 1980

[51] Int. Cl.[3] ..... A47G 29/10

[52] U.S. Cl. ..... 70/456 B

[58] Field of Search ..... 70/456 R, 456 B, 459; 150/40; 24/3 K, 73 A, 101 B, 237

[56] References Cited

U.S. PATENT DOCUMENTS

| | | | |
|---|---|---|---|
| 533,373 | 1/1895 | Presby | 70/456 R |
| 1,641,110 | 8/1927 | Wulfing | 70/456 R |
| 2,508,024 | 5/1950 | Hanna | 70/456 B |
| 2,978,897 | 4/1961 | Capitani | 70/456 B |
| 3,677,044 | 7/1972 | DeFrees | 70/456 R |

*Primary Examiner*—Robert L. Wolfe

*Attorney, Agent, or Firm*—Gottlieb, Rackman & Reisman

[57] ABSTRACT

A key holder is provided to enable a key to be readily attached to or detached from a key ring. The key holder includes a snap lock permanently attachable to the head of a key, and a spring clip engageable in a slot in the snap lock. The snap lock has a pair of legs which can engage the usual aperture in the key from opposite sides thereof, and the snap lock further has a mount which contains a configured slot. The spring clip is made of spring wire, and includes a retainer which can slip into the slot, but cannot withdraw from it, and a ring which has one leg which can be swung away from the remainder of the key holder, to permit engagement with a key ring.

7 Claims, 9 Drawing Figures

KEY HOLDER

The present invention relates to a key holder, of the type that can readily permanently be attached to a conventional key, and can quickly and safely be attached to or removed from a key ring.

The primary object of the present invention is to provide a key holder simple in structure and economical in manufacture, which can both speedily attach to a key, and which with little effort can be attached to or removed from a key ring.

Present day demands for safety and security require a simple and easily operable mechanism whereby a user can readily attach or detach a key from a key ring which holds a number of such keys. This may be desired, by way of example, when a car owner parks his car in a public garage, and is required to leave his car keys with the garage attendant. The car owner then should have avalable a simple device whereupon he can remove his car ignition key from the key ring, which key he then leaves with the attendant. This same device should permit quick reattachment of the car ignition key to the key ring, when the car owner returns to the garage to pick up his car.

For this purpose, a key holder is provided to enable a key to be readily attached to or detached from a key ring. The key holder includes a snap lock permanently attachable to the head of a key, and a spring clip engageable in a slot in the snap lock. The snap lock has a pair of legs which can engage the usual aperture in the key from opposite sides thereof, and the snap lock further has a mount which contains a configured slot. The spring clip is made of spring wire, and includes a retainer which can slip into the slot, but cannot withdraw from it, and a ring which has one leg which can be swung away from the remainder of the key holder, to permit engagement with a key ring.

The construction and operation of the key holder will be better understood by reference to the following drawings, wherein.

Figure 4:
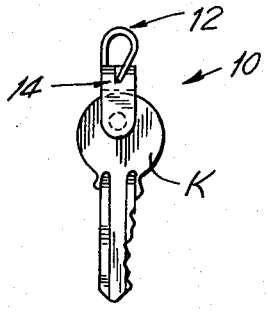
FIG. 4 is a front view of the key holder attached to a key.
Figure 5:
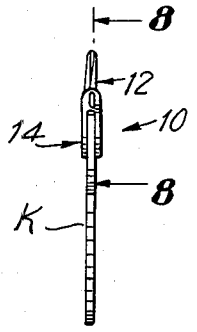
FIG. 5 is a side view of the key holder attached to a key.

Referring now in detail to the key holder 10 of the present invention, the same is shown attached to a conventional key K in FIGS. 4 and 5. Specifically, the key holder engages the aperture conventionally found in the head of the key K.

Figure 1:
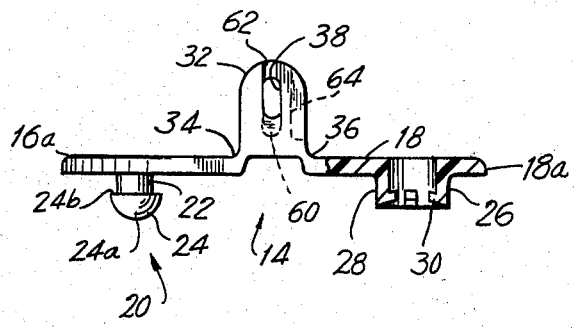
FIG. 1 shows in side elevation, the key holder of the present invention, with the snap lock in open position.
Figure 2:
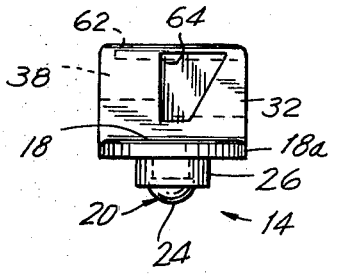
FIG. 2 is an end view of the key holder of FIG. 1.
Figure 3:
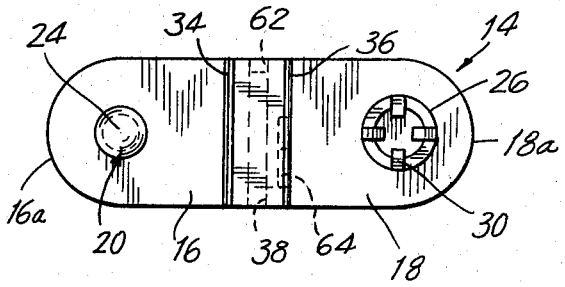
FIG. 3 is a bottom view of the key holder of FIG. 1.
Figure 6:
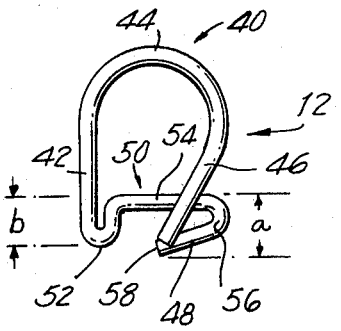
FIGS. 6 and 7 are, respectively, front and side view of the spring clip which is a component of the key holder.
Figure 7:
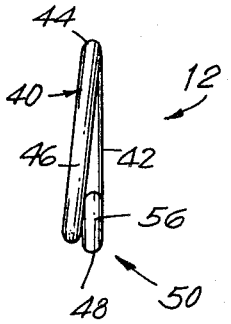

The key holder 10 comprises two interlocking components, namely a spring clip 12 shown in FIGS. 6 and 7 and a snap lock 14, shown in FIGS. 1, 2 and 3.

Figure 9:
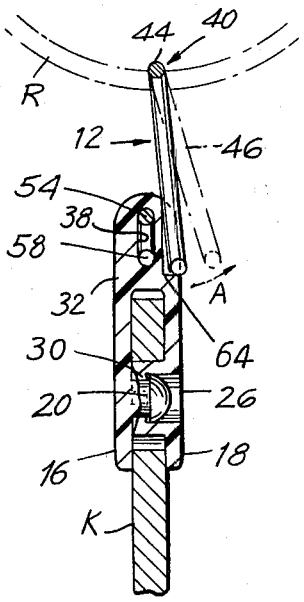
FIG. 9 is a cross-sectional view of the key holder, taken along the line 9—9 of FIG. 8.

Referring first o the snap lock 14, the same includes a pair of opposed legs, namely, a male leg 16 and a female leg 18. Both legs 16, 18 optionally have similar external dimensions, including curved end portions 16*a*, 18*a*, as shown in FIGS. 1 and 3, so that when the legs move into overlapping relation, as shown in FIGS. 5 and 9, they are coextensive, on opposite sides of the head of the key K. Both legs are of relatively narrow thickness. The leg 16 or both legs 16, 18 may be somewhat enlarged to enable the printing of advertising material thereon.

The male leg 16 carries on its inside surface, a protruding stud 20, having a neck 22, which terminates in an enlarged head 24. The head is of hemipherical configuration, with a leading spherical portion 24*a* ending in a flat surface 24*b*, such surface being of greater diameter than the diameter of the neck 22.

The famale leg 18 carries a throat 26 on its inside surface, the throat being in alignment with the stud 20, when the legs 16, 18 move towards one another. The throat 26 comprises an encircling wall 28 which surrounds and defines a through-aperture, and the distant end of wall 28 carries four inwardly-projecting tabs 30.

The legs 16 and 18 are connected by a central mount 32, and specifically, the mount includes two thin-walled extensions 34, 36, which merge into the legs 16, 18, respectively, as best seen in FIG. 1.

The entire snap lock 14 is made of an appropriate plastic, whereby the legs 16, 18 can readily turn about the mount 32, by swinging on the extensions 34, 36, from the position shown in FIG. 1 to the position shown in FIG. 9.

To join the snap lock 14 to a key K, the throat 26 is placed into the aperture in the head of the key K, from one side of the key, while the head 24 enters into the throat 26 from the other side of the key K. As will be seen in FIGS. 8 and 9, once the head 24 enters into the throat 26, and the spherical portion 24*a* of the head 24 passes and pushes aside the tabs 30, the tabs under-lie the surface 24*b* of the head 24, to permanently hold the head 24 therein. This in effect locks the legs 16, 18 on either side of the head of the key, causing a permanent connection between the snap lock 14 and the key K.

Figure 8:
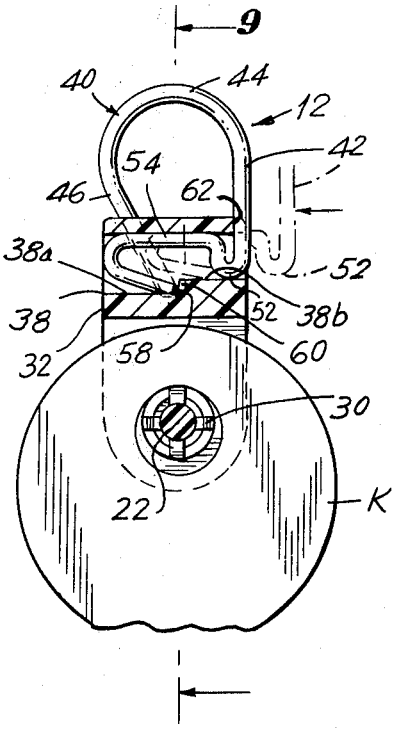
FIG. 8 is a front, partially cross-sectional view of the key holder, taken along the lines 8—8 of FIG. 5.

As shown in FIGS. 8 and 9, the diameter of the exterior of the throat 26 is made somewhat less than the usual diameter of the aperture in the head of the key K, permitting some degree of rotation between the key K and the snap lock 14.

The mount 32 of the snap lock 14 includes a narrow slot 38 formed along its long axis, to receive a portion of the spring clip 12. The configuration of this slot 38 will be discussed subsequently.

The spring clip 12 includes an open, inverted "U" ring 40, which comprises an upright leg 42, joined to a curved central leg 44, and joined to an inwardly curved downward leg 46, terminating in a tip 48.

As best shown in FIGS. 6 and 7, the spring clip 12 further includes a retainer 50, which comprises a U-shaped curve 52, which is formed at the lower end of the upright leg 42, which in turn is joined to an elongated horizontal leg 54, which is joined to a curved insertion leg 56. The leg 56 terminates in a tip 58, which is located adjacent to the tip 48 of the leg 46. As shown in FIGS. 6 and 7, the leg 46 overlaps the insertion leg 56, in a "spiral" relationship.

The retainer 50 and the ring 40, are all made of one continous length of spring metal.

The retainer 50 is configured so that it can readily enter into and thereafter be retained in the slot 38 in the mount 32. For this purpose, the slot 38 while narrow in width has at different portions thereof, two heights, a greater height shown at portion 38*a* of the slot, and a lesser height shown at portion 38*b* of the slot, see FIG. 8. The height of the slot 38 at portion 38*a*, is substantially the distance between the outer dimensions of the leg 54 and the tip 58, this being dimension a on FIG. 6. Furthermore, the height of the slot 38 at portion 38*b*, is substantially the distance between the outer dimensions of the leg 54 and the curve 52, shown as dimension b on FIG. 6. The difference between the height of the portions 38*a* and 38*b*, again as seen in FIG. 8, in the slot 38 causes a shoulder 60 to be formed at the bottom surface of the slot.

Two additional configurations are provided in the mount 32. A small cut-out 62 is formed at one end of the mount 32, this being the end of the mount closest to the portion 38*b* of the slot 38. Furthermore, one side exterior of the mount 32 contains a notch 64, shown in FIGS. 1, 2 and 3.

Assembly of the spring clip 12 with the mount 32, is carried out in the following manner, see FIG. 8. The clip 12 is oriented so that the insertion leg 56 of the retainer 50 begins to enter the narrower portion 38*b* of the slot 38.

As this entry takes place, the lower portion of the leg 56 bends onto itself, to permit it to enter this narrower portion 38*b*. This insertion continues, until the tip 58 of the leg 56 reaches the shoulder 60 in the slot, whereupon the insertion leg 56 can expand, since the tip 58 has reached the larger portion 38*a* of the slot 38. At the same time, the curve 52 enters and fits into the narrower portion 38*b* of the slot, and the upright leg 42 fits into the cut-out 62. The lower portion of the leg 46 and the tip 48 are now nestled in the notch 64. In FIG. 8, the dotted lines outlining the upright leg 42 show a partial entry position of the retainer 50 in the slot 38, while the full lines show the retainer 50 fully engaged in the slot 38. The engagement of the leg 42 into the cut-out 62, prevents relative rotation of the ring 40 and the snap lock 14.

The retainer 50 cannot be withdrawn from the slot 38, because the tip 58 of the insertion leg 56 is blocked from such outward movement by its engagement with the shoulder 60.

The ring is intended to be readily engaged with, but also to be readily detachable from a key ring R. To engage the ring 40 to the key ring R, it is only necessary to move the leg 46 slightly outwardly, in the direction shown by the arrow A, so that the tip 48 is distant from the notch 64, as is shown by comparison of the dotted line showing in FIG. 9 with respect to leg 46 and the solid lines therefor, so that a portion of the key ring R can slip through this formed opening. Of course, a portion of the key ring R itself can be utilized to open this leg 46. When the key ring R now reaches the upper portion of the ring 40, as for example being located adjacent the inside of the central leg 44, the leg 46 once more springs back and resumes its initial position, nestled in the notch 64. To remove the key ring R from the key holder 10, the holder is slightly twisted, thus pushing the leg 46 away from the notch 64, enabling the ring R to slip off the end of the leg 46. The twisting of the holder may be done via the key ring R.

Accordingly, there has been shown a key holder 10, which can be readily attached to any conventional key A, by a simple maneuver, by a purchaser thereof. The ring 40 can be easily attached to or detached from a key ring R for the convenience of the owner of the key.

There is claimed:

1. A key holder for a key comprising a snap lock permanently attachable to the key the snap lock having a configured slot therein, and a spring clip, the spring clip including a retainer engageable in the slot and a ring attached to the retainer, the ring having one free end biased toward but bendable away from the snap lock, to enable ready attachment to and removal from a key ring.

2. A key holder as set forth in claim 1, wherein the snap lock is formed of a plastic and the spring clip is formed of a single length of spring metal.

3. A key holder as set forth in claim 1, wherein the snap lock has a notch on an external side thereof, and the free end of the ring nestles in said notch.

4. A key holder as set forth in claim 1, wherein the slot has a portion of lesser height and a portion of greater height, a shoulder being formed in the slot between such different heights, and the retainer has a spring leg passable through the portion of the slot of lesser height and being expandable into the portion of the slot of greater height.

5. A key holder as set forth in claim 1, wherein the configuration of the ring is of inverted "u" shape, including an uprising leg, a curved leg and a depending leg, the depending leg being bendable away from the snap lock.

6. A key holder as set forth in claim 1, wherein the retainer has a spring leg insertable into the slot, the slot further including a shoulder stationed to prevent removal of such spring leg.

7. A key holder as set forth in claim 1, wherein the snap including a pair of opposed legs matable with one another on opposed sides of the key, the snap lock further including a mount in which the slot is situated.

* * * * *